US005697799A

United States Patent [19]

Consoli et al.

[11] Patent Number: 5,697,799

[45] Date of Patent: Dec. 16, 1997

[54] BOARD-MOUNTABLE SHIELDED ELECTRICAL CONNECTOR

[75] Inventors: John Joseph Consoli, Harrisburg; Lynn Robert Sipe, Lewistown, both of Pa.

[73] Assignee: The Whitaker Corporation, Wilmington, Del.

[21] Appl. No.: 690,685

[22] Filed: Jul. 31, 1996

[51] Int. Cl.[6] ..... H01R 13/53

[52] U.S. Cl. ..... 439/181; 439/607; 439/910

[58] Field of Search ..... 439/181, 186, 439/607, 910, 83

[56] References Cited

U.S. PATENT DOCUMENTS

| | | | |
|---|---|---|---|
| 4,824,377 | 4/1989 | De Burro | 439/186 |
| 5,037,330 | 8/1991 | Fulponi et al. | 439/607 |
| 5,066,240 | 11/1991 | Verdun | 439/181 |
| 5,085,590 | 2/1992 | Galloway | 439/95 |
| 5,096,440 | 3/1992 | Katsumata | 439/570 |
| 5,167,531 | 12/1992 | Broschard, III et al. | 439/540 |
| 5,177,671 | 1/1993 | Atoh | 361/392 |
| 5,342,220 | 8/1994 | Kodama | 439/607 |
| 5,470,259 | 11/1995 | Kaufman et al. | 439/607 |
| 5,558,540 | 9/1996 | Kato et al. | 439/637 |
| 5,567,168 | 10/1996 | Marsh et al. | 439/607 |
| 5,567,169 | 10/1996 | McCleerey et al. | 439/607 |

OTHER PUBLICATIONS

*AMP Catalog* 82244, "CHAMP .050 Series Connectors", (May 1995); pp. 3–5, 30, 31 and 62–67; AMP Incorporated, Harrisburg, PA.

*Hirose Catalog*, "HRS FX8 Series", pp. 1 to 21; (Mar. 1996); Hirose Electric Co., Inc., Tokyo, Japan.

*Primary Examiner*—Gary F. Paumen

*Attorney, Agent, or Firm*—Anton P. Ness

[57] ABSTRACT

An electrical connector (10) having a housing (12) with two or more plug-receiving cavities (14,16) each having two rows of contacts (20,22) therein extending from the mating face (12) to solder tails (26,28) along the connector's board-mounting face (24). An inspection aperture (30) allows visual inspection of the solder terminations of the solder tails (28) of the inner contact rows (22) to pads of circuit board. An integral ESD shell (32) traverses the mating face and includes plug-receiving slots (38,40) and an inspection slot (42) aligned with the housing apertures (14,16,30), and narrow strips (44) between the slots are supported by orthogonal shell wall sections (48) protecting the narrow strips (44) from damage during handling and assembly.

7 Claims, 5 Drawing Sheets

BOARD-MOUNTABLE SHIELDED ELECTRICAL CONNECTOR

FIELD OF THE INVENTION

This relates to electrical connectors and more particularly to shielded connectors.

BACKGROUND OF THE INVENTION

Certain electrical connectors are used in environments where an electrostatic potential commonly develops between the apparati to which each of a matable pair of electrical connectors is mounted, with damaging consequences to sensitive electronic components of the apparati upon uncontrolled discharge of this potential if the potential is great enough. An example of this is concerned with an electronic apparatus such as a computer to which peripheral apparatus such as a notebook computer is to be electrically connected or docked at a docking station of the computer or an add-on docking module, or a cable harness connected thereto. Discharge of the potential can occur along signal lines upon mating of the cable and port connectors, with the surge possible capable of damaging the electronic components to which the signal lines lead.

In U.S. Pat. Nos. 5,567,168 and 5,567,169, both issued Oct. 22, 1996 and both assigned to the assignee hereof, connectors are disclosed having shields disposed across mating faces of receptacle connectors with multiple rows of contacts exposed at a mating face within multiple elongate plug-receiving cavities, and a conductive shell surrounds the housing for shielding. A grounding strip or drain wire is affixed at the mating face across the forwardmost connector portion between each pair of adjacent plug-receiving cavities, and is commoned to the shell.

It is desired to provide a connector mountable to a circuit board with a shield traversing the mating face to attract and dissipate electrostatic discharge prior to electrical connection of the signal contact pairs, upon being mated to a mating connector.

It is further desired to provide such a connector with a shield that permits visual inspection of the solder joints of the contacts with pads of the circuit board, and reworking thereof, if necessary.

SUMMARY OF THE INVENTION

The present invention provides a connector with a shield for being mounted in a vertical orientation on a circuit board. The connector is of the type having a pair of plug-receiving cavities with two rows of contacts extending from the top or mating face to the bottom or board-mounting face. The connector defines an elongate inspection opening permitting visual inspection, and receipt of soldering tools thereinto for reworking if necessary, of the solder joints of the contacts of the inner rows associated with each plug-receiving cavity of the connector with circuit pads on the circuit board, where the solder joints of inner rows of contacts are remote from outer connector edges and are otherwise hidden by the connector, unlike the joints of the outer rows of contacts with respective pads visible along the outer edges. The inspection opening exposes the circuit board surface adjacent the inner rows of contacts and the contact pads thereof for connection to the solder tails of the contacts of the inner rows.

The shield covering the top or mating face of the housing contains a corresponding inspection slot coincident with the housing's aperture located between a pair of slots coincident with plug-receiving cavities of the housing along the mating face. The shield is stamped and formed from a blank of metal to define the plug-receiving slots and the inspection slot. The inspection slot is formed by forming an H-shaped slit pattern that results in a pair of adjacent elongate short-height flaps, and the flaps are then bent out of the plane of the blank to extend from the resultant slot and along side walls of the aperture of the housing when the shield is mounted thereto. The flaps define strength members to support the narrow shield strips located between the plug-receiving cavities and the inspection slot rendering the shield rugged and durable.

An embodiment of the invention will now be described by way of example with reference to the accompanying drawings.

DETAILED DESCRIPTION

Figure 1:
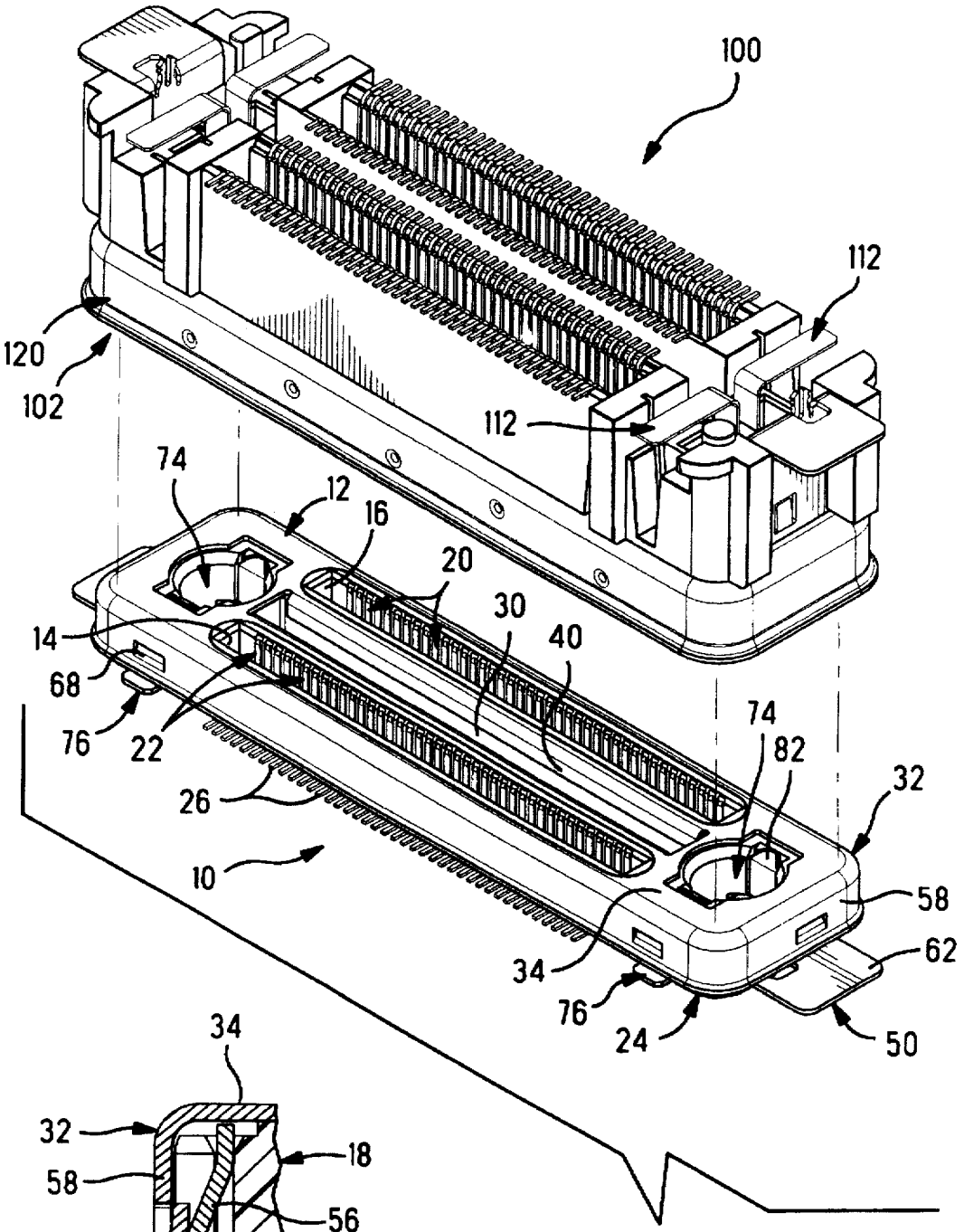
FIGS. 1 and 2 are isometric views of the pair of mating plug and receptacle connectors with which the present invention is used, showing the mating faces and board-mounting faces of each and the contacts thereof disposed in four rows.

Receptacle connector 10 is matable with a plug connector 100 along mating faces 12,102 thereof, with receptacle connector 10 providing two plug-receiving cavities 14,16 and the plug connector defining corresponding plug portions 104,106 complementary therewith. Contacts 20,22 are mounted in housing 18 are disposed in two rows with contact sections thereof exposed for electrical connection in each plug-receiving cavity 14,16. Plug connector 100 is described in greater detail in U.S. patent application Ser. No. 08/690,085 filed Jul. 31, 1996 and assigned to the assignee hereof.

Receptacle connector 10 has an ultra-low profile and is suitable for mounting in the very confined space of a notebook computer, for example. Receptacle connector 10 includes a board-mounting face 24 opposed from mating face 12, with contacts 20,22 including solder tails 26,28 adapted for surface mount soldering to contact pads of a circuit board (not shown). Solder tails 26 of outer rows of contacts 20 extend outwardly of side walls of housing 18 in which case the solder joints thereof are exposed for visual inspection. However, solder tails 28 of inner rows of contacts 22 are soldered to respective contact pads beneath the connector. Consequently an inspection aperture 30 is provided in connector 10 extending from mating face 12 to board-mounting face 24 exposing solder tails 28 of the inner rows for visual inspection of their solder joints.

Low profile receptacle connector 10 further includes a shell 32 having a top wall 34 extending across the mating face and side walls 36 along side walls of the housing to the board-mounting face. Shell 32 is electrically connectable to a ground path leading to chassis ground, and serves to attract any discharge of electrostatic potential (ESD) from any source including mating connector 100 during mating. Top wall 34 includes a pair of plug-receiving slots 38,40 corresponding to and aligned with plug-receiving cavities 14,16 to permit receipt of plug portions 104,106 of plug connector 100. An inspection slot 42 is also defined in top wall 34 between plug-receiving slots 38,40 aligned with inspection aperture 30 of housing 18 to allow visual inspection of the solder joints of the contacts of the inner rows.

Figure 4:
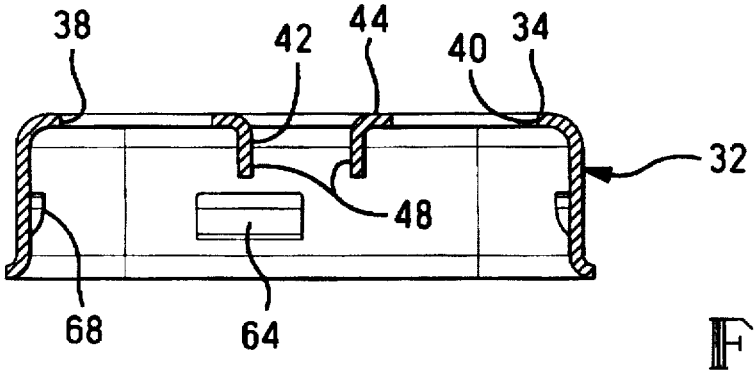
FIG. 4 is a cross-section across the shield member of FIG. 3.
Figure 3:
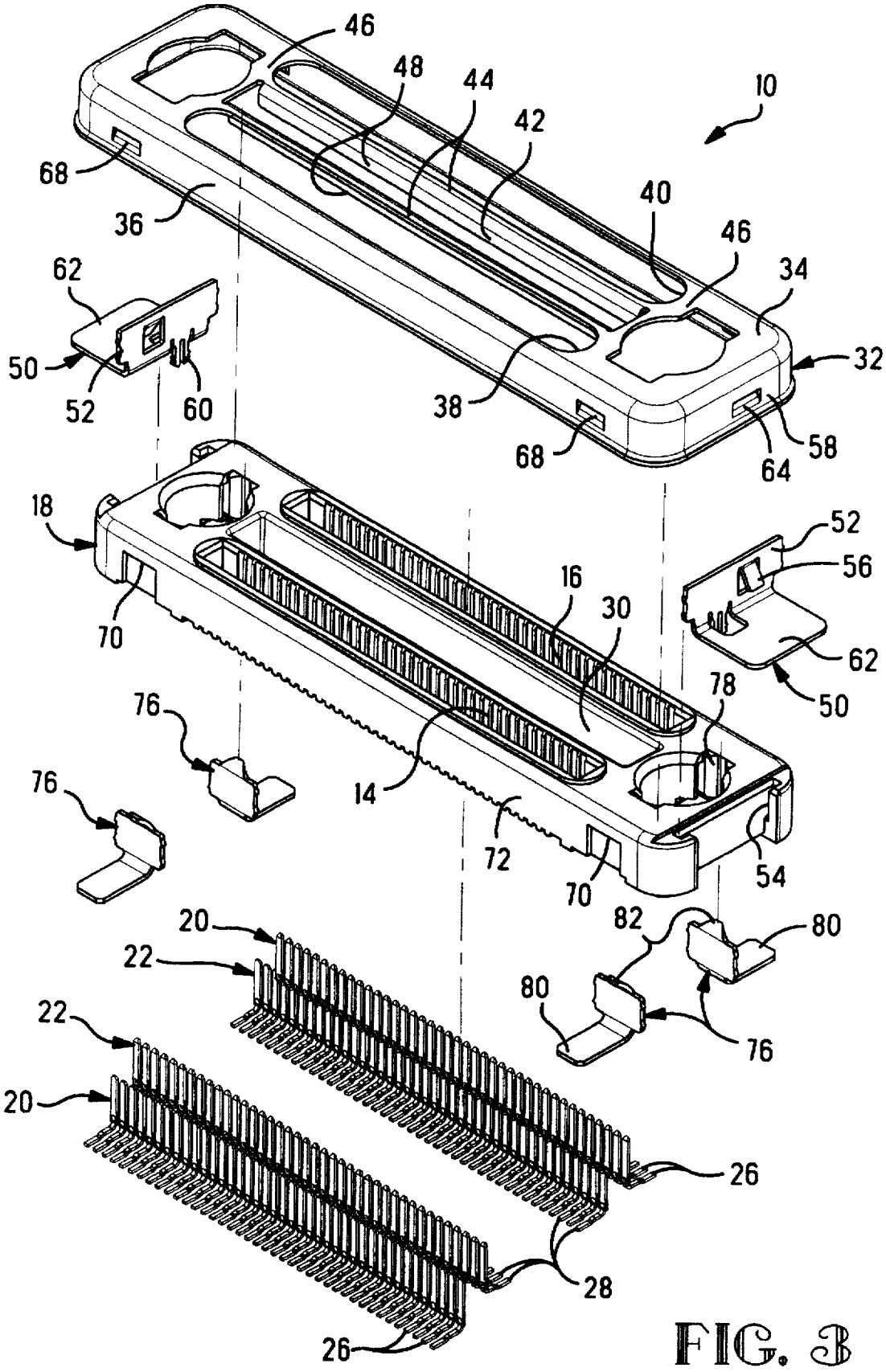
FIG. 3 is an exploded isometric view of the receptacle connector of FIGS. 1 and 2.

Strips or webs 44 of top wall 34 remain between plug-receiving slots 38,40 and inspection slot 42 extending between end portions 46, that have a very narrow dimension that would generally be considered delicate. However, during forming of shell 32, in order to create inspection slot 42, an elongate H-shape is first stamped into the metal blank extending between end portions 46 of the top wall so that a pair of elongate flaps 48 are formed. Flaps 48 are then bent about orthogonally into inspection slot 42 (best seen in FIG. 4) and thereafter define strength ribs or wall sections for supporting strips 44 especially useful during handling of shell 32 prior to and during assembly of connector 10, thus assuring that strips 44 remain intact and undistorted to serve the shell's ESD protection purpose especially along the inner contact rows, during in-service use of the connector.

Figure 5:
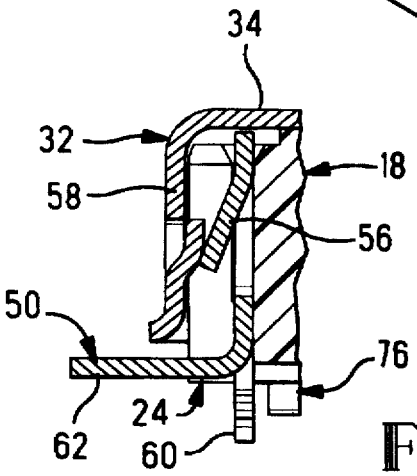
FIG. 5 is an enlarged part longitudinal section of the receptacle connector of FIGS. 1 and 2 showing the ground connection of the shield member to a ground bracket.
Figure 2:
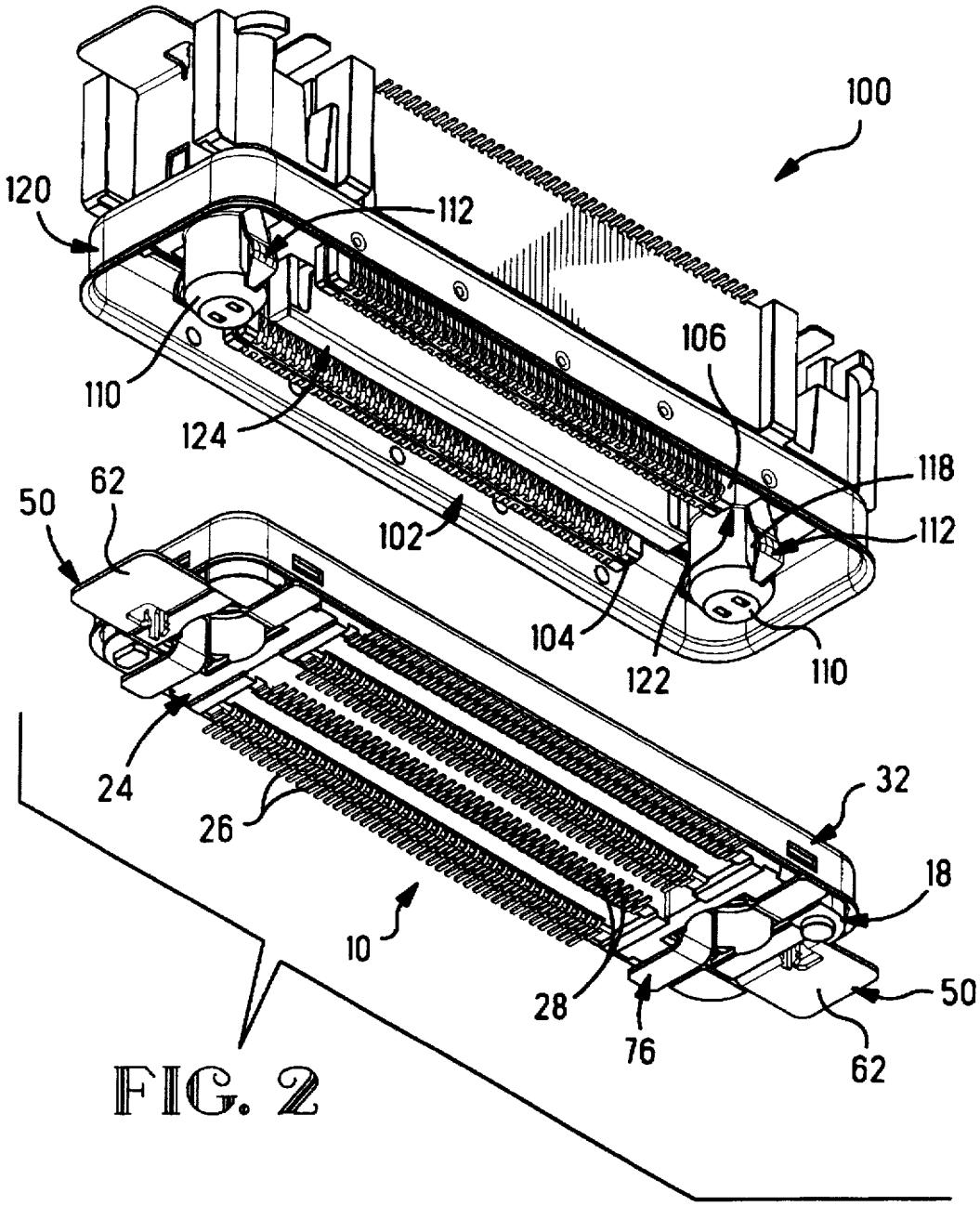

Grounding of shell 32 is obtained by conductive mounting brackets 50 having body sections 52 inserted in a force fit into slots 54 at ends of housing 18, including spring arms 56 protruding outwardly to engage end walls 58 of shell 32, as shown in FIG. 5. Brackets 50 include contact sections 60 extending into through-holes of the board for connection to ground circuits of the board. Brackets 50 may further include transverse tabs 62 extending along the surface of the circuit board useful such as for mounting thereto. Preferably, engagement embossments 64 are formed in shell end wall 58 to be engaged by spring arms 56 of brackets 50.

Figure 6:
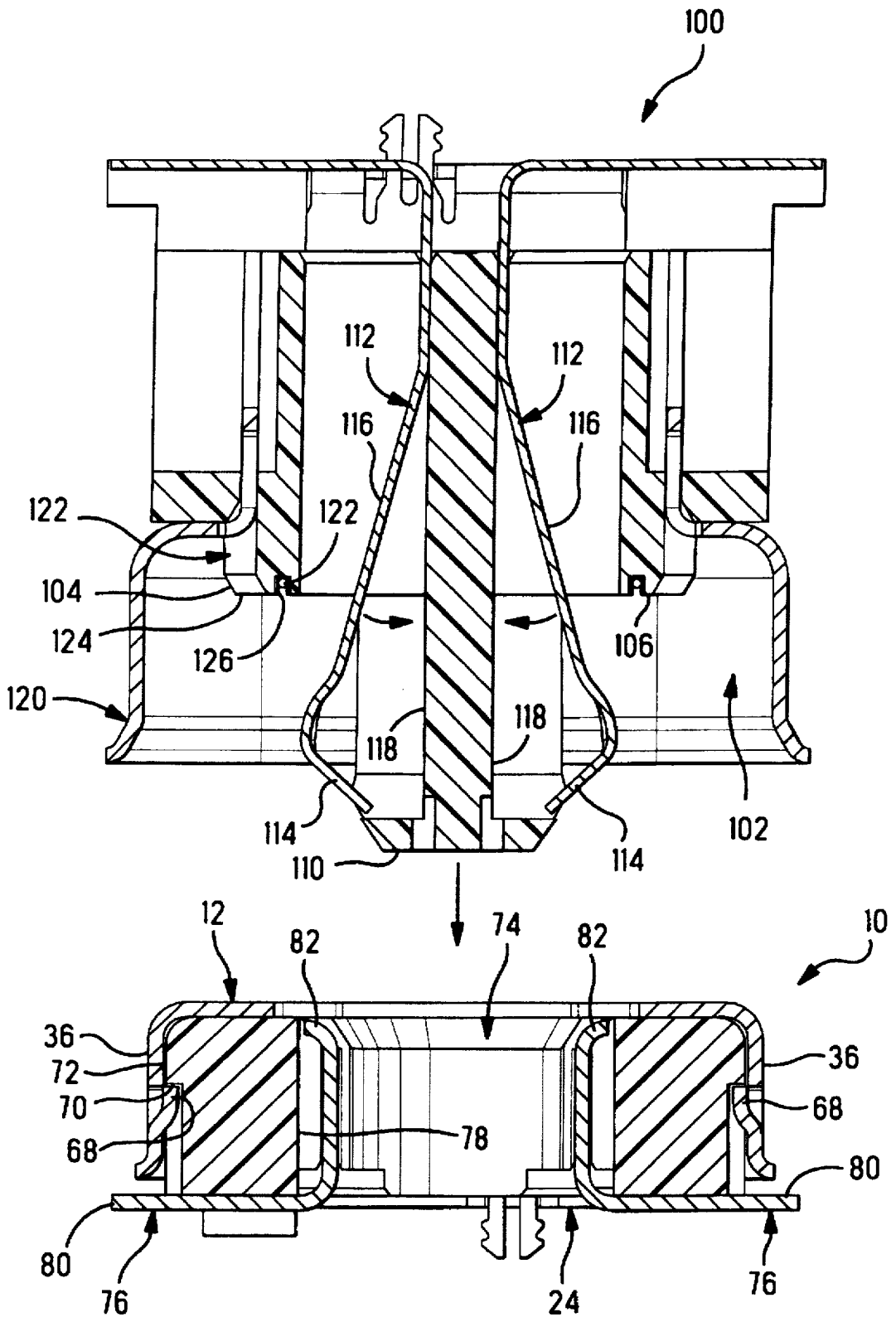
FIG. 6 is a cross-sectional view through both connectors of FIGS. 1 and 2 at the alignment regions near each connector end.

As is seen in FIG. 6, shell 32 is securable to housing 18 by a plurality of lances 68 embossed inwardly along side walls 36 to define upwardly facing stop surfaces latchable beneath ledges 70 along side walls 72 of housing 18, preferably near each connector end.

Alignment holes 74 are formed in connector 10 for receipt thereinto of alignment posts 110 of plug connector 100, for self-adjusting movement thereof during blind mating thereof with receptacle connector 10. Pairs of power contacts 76 are securable within connector 10 adjacent alignment holes 74, force-fit within slots 78 of housing 18 along opposed sides of holes 74. Power contacts 76 include transverse sections 80 extending along board-mounting face 24 of the connector for being soldered to power circuits of the circuit board. Arcuate free ends 82 are formed at tops of power contacts 76 to facilitate engagement with corresponding power contacts 112 of connector 100 during mating. Free ends 114 of power contacts 112 are formed at an angle at ends of cantilever beam spring arms 116, and, upon engagement with arcuate free ends 82, are deflected into clearance slots 118 into opposed sides of alignment posts 110 and remain in spring biased engagement with power contacts 76 thereafter.

Shell 120 surrounds housing 122 of connector 100 and forms a shroud about the plug portions 104,106 and the alignment posts 110 and power contacts 112. A conductive insert 124 is insertable into a solder inspection slot of connector 100 after soldering and advantageously provides ESD protection intermediate the side walls of shell 120 and proximate to inner sides of plug portions 104,106. Alternatively, or additionally, ground wires 122 traverse leading ends 124 in corresponding grooves 126 of plug portions 104,106 and are terminated to shell 120, all in a conventional manner, to provide ESD protection to center regions of the connector.

Figure 7:
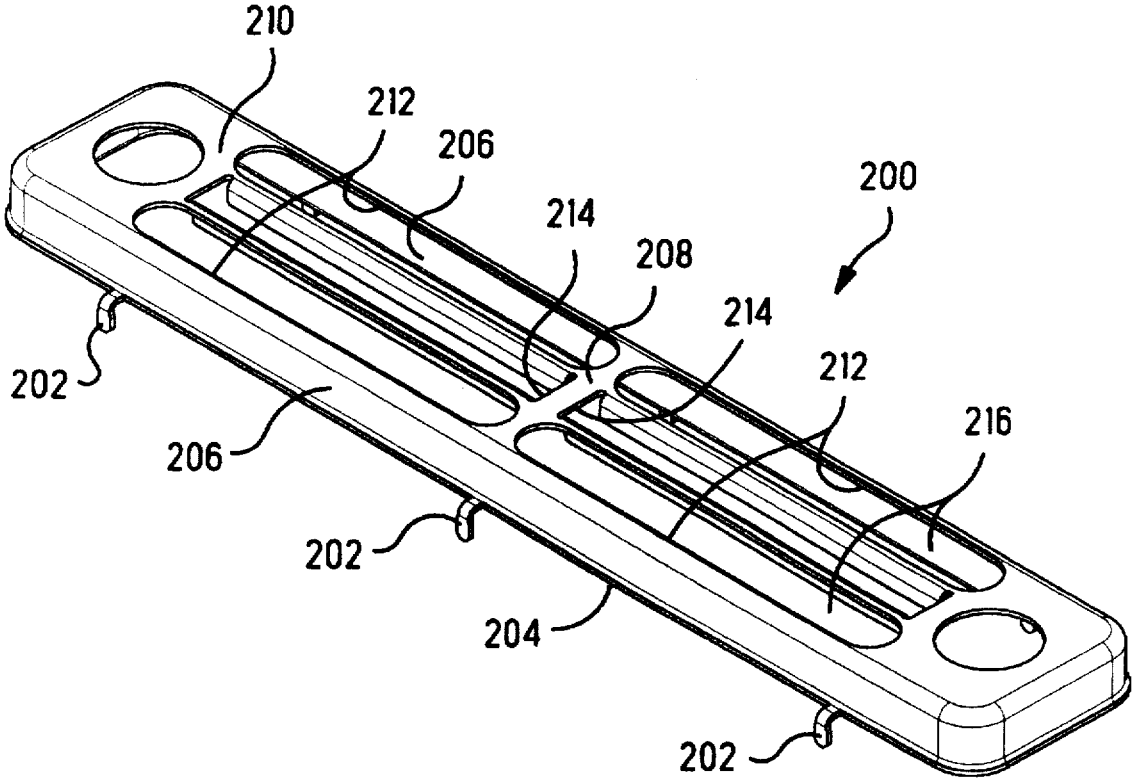
FIG. 7 is an isometric view of an alternate embodiment of an integral shell of the present invention.

With the present invention, shell 32 is fabricated in a single piece, such as from stainless steel or brass stock, simplifying connector manufacture and facilitating assembly thereof. FIG. 7 illustrates an alternate embodiment of integral shell 200. A plurality of ground contact sections 202 extend outwardly from lower edges 204 of side walls 206 and downwardly for insertion into through holes of a circuit board, thus serving to establish ground connections at a plurality of locations that may be desirable for elongate shells. Of course, the ground contact sections may extend horizontally for surface mounting to the board, if desired. Also shell 200 is shown to be elongated compared with shell 32 of FIGS. 1 to 5, for use with a connector having a greater number of signal contacts therein than connector 10 of FIGS. 1 to 5, disposed in a plurality of plug-receiving cavities in rows. Shell 200 is shown to include a transverse central bight 208 joining the side walls 206 along mating face 210 between the connector's plug-receiving cavities, thus dividing the shell's mating face into a plurality of plug-receiving slots 212 and inspection slots 214 in rows thereof, and serving to further strengthen narrow strips 216 as well as minimizing any bowing of side walls 206.

The present invention of the integral shell with strengthened narrow strips between elongate apertures, may also be utilized in connectors that may not include an inspection aperture, where there is a necessity for closely spaced elongate shell apertures. The connector housing need only provide a clearance for receipt of the flaps thereinto such that the flaps are isolated from contacts of the connector and from contacts of the mating connector.

Other modifications, revisions and uses for the present invention may be devised that are within the spirit of the invention and the scope of the claims.

What is claimed is:

1. An electrical connector of the type having an insulative housing defining a mating face and an opposed board-mounting face and at least a pair of elongate plug-receiving cavities therethrough along each of which are positioned contact sections of contacts in opposed rows where the contacts include solder tails for surface mounting to circuit pads of a circuit board, the connector comprising:

the insulative housing including an elongate aperture extending from the mating face to the board-mounting face between adjacent ones of the plug-receiving cavities and exposing solder tails of rows of the contacts arrayed in the interior of the housing for visual inspection thereof; and an integral shell extending across at least the mating face of the connector and including at least a pair of plug-receiving slots therethrough aligned with the plug-receiving cavities of the housing, and further including an inspection slot aligned with each elongate aperture of the housing, integral narrow strips extending between each inspection slot and an adjacent one of the plug-receiving slots, whereby when the shell member is connected to ground, the shell member provides protection of the connector from electrostatic discharge at the mating face.

2. The electrical connector as set forth in claim 1 wherein the shell includes orthogonal wall sections extending integrally from the narrow strips along side edges of each inspection slot and into the corresponding one of the elongate apertures of the housing upon assembly to the connector, providing support to the narrow strips during handling and assembly.

3. The electrical connector as set forth in claim 1 wherein the shell includes a transverse bight bifurcating the mating face thereof and said plug-receiving slots, and said inspection slot and integrally joining with side walls of the shell and with said narrow strips.

4. The electrical connector as set forth in claim 1 wherein the shell includes a plurality of board-connecting contact sections extending from board-adjacent edges of side walls of the shell.

5. An electrical connector of the type having an insulative housing defining a mating face and an opposed board-mounting face and at least a pair of elongate plug-receiving cavities therethrough along each of which are positioned contact sections of contacts in opposed rows where the contacts include solder tails for surface mounting to circuit pads of a circuit board, the connector comprising:

an integral shell extending across at least the mating face of the connector and including at least a pair of plug-receiving slots therethrough aligned with the plug-receiving cavities of the housing, and further including a slot between adjacent ones of the plug-receiving slots, integral narrow strips extending between each inspection slot and an adjacent one of the plug-receiving slots, and orthogonal wall sections extending integrally from the narrow strips along side edges of each inspection shell slot and into clearance spaces of the housing upon assembly to the connector, providing support to the narrow strips during handling and assembly, whereby when the shell member is connected to ground, the shell member provides protection of the connector from electrostatic discharge at the mating face.

6. The electrical connector as set forth in claim 4 wherein the shell includes a transverse bight bifurcating the mating face thereof and said plug-receiving slots and said inspection slot and integrally joining with side walls of the shell and with said narrow strips.

7. The electrical connector as set forth in claim 4 wherein the shell includes a plurality of board-connecting contact sections extending from board-adjacent edges of side walls of the shell.

* * * * *